US007765726B2

(12) United States Patent
Küper

(10) Patent No.: US 7,765,726 B2
(45) Date of Patent: Aug. 3, 2010

(54) SANDWICH SCRAPER STRIP HAVING A HARD METAL CORE

(75) Inventor: Roland Küper, Bochum (DE)

(73) Assignee: Gummi Küper GmbH & Co. KG, Bochum (DE)

( * ) Notice: Subject to any disclaimer, the term of this patent is extended or adjusted under 35 U.S.C. 154(b) by 114 days.

(21) Appl. No.: 11/629,721

(22) PCT Filed: May 25, 2005

(86) PCT No.: PCT/EP2005/005630

§ 371 (c)(1),
(2), (4) Date: Jan. 9, 2007

(87) PCT Pub. No.: WO2005/124031

PCT Pub. Date: Dec. 29, 2005

(65) Prior Publication Data

US 2007/0193755 A1 Aug. 23, 2007

(30) Foreign Application Priority Data

Jun. 17, 2004 (DE) ..... 10 2004 029 165

(51) Int. Cl.
*E02F 3/00* (2006.01)

(52) U.S. Cl. ..... 37/460; 37/233; 37/266; 172/701.3

(58) Field of Classification Search ..... 37/266, 37/457–460
See application file for complete search history.

(56) References Cited

U.S. PATENT DOCUMENTS 2,549,088 A * 4/1951 Hettelsater et al. ..... 37/189
3,529,677 A * 9/1970 Stephenson ..... 172/701.3
3,934,654 A * 1/1976 Stephenson et al. ..... 172/701.3
4,086,966 A * 5/1978 Lanz et al. ..... 172/701.3
4,347,677 A * 9/1982 Kuper ..... 37/233
4,715,450 A * 12/1987 Hallissy et al. ..... 172/701.3
H1642 H * 4/1997 Jenkins ..... 405/159
5,743,032 A * 4/1998 Vauhkonen ..... 37/446
5,813,474 A * 9/1998 Manway ..... 172/701.3
5,852,272 A * 12/1998 Amano ..... 219/76.14
6,202,327 B1 * 3/2001 Fuller et al. ..... 37/220
6,571,493 B2 * 6/2003 Amano et al. ..... 37/460
6,594,923 B1 * 7/2003 Kost et al. ..... 37/231
2003/0188463 A1 * 10/2003 Manway et al. ..... 37/460

FOREIGN PATENT DOCUMENTS

DE 33 47 784 A1 5/1985
DE 34 04 030 C1 7/1985
DE 85 16 577 U1 8/1985
DE 87 07 182 U1 8/1987

OTHER PUBLICATIONS

International Search Report.

* cited by examiner

*Primary Examiner*—Thomas B Will
*Assistant Examiner*—Mai T Nguyen
(74) *Attorney, Agent, or Firm*—Collard & Roe, P.C.

(57) ABSTRACT

The invention relates to a sandwich scraper strip for the blade of a snowplow and provided at the top with a steel fastening neck onto which a rubber body having at least one embedded hard material body is molded. According to the invention, the hard material body is provided in the form of a hard metal core surrounded by a steel jacket. This results in achieving a surprisingly high serviceable life of the sandwich scraper blade.

8 Claims, 3 Drawing Sheets

SANDWICH SCRAPER STRIP HAVING A HARD METAL CORE

CROSS REFERENCE TO RELATED APPLICATIONS

Figure 1:
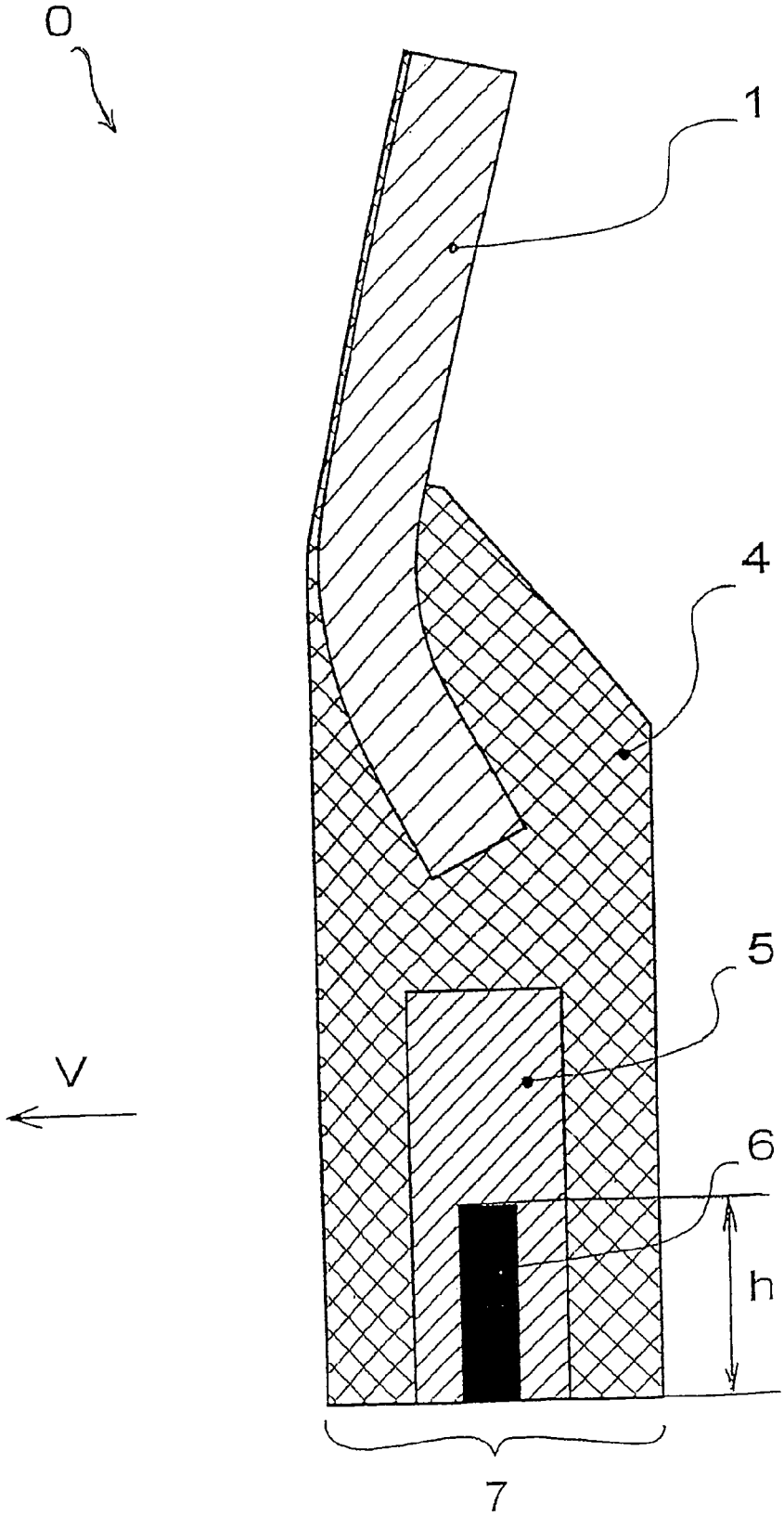

Applicant claims priority under 35 U.S.C. §119 of German Application No. 10 2004 029 165.9 filed Jun. 17, 2004. Applicant also claims priority under 35 U.S.C. §365 of PCT/EP2005/005630 filed May 25, 2005. The international application under PCT article 21(2) was not published in English.

The present invention relates to a sandwich scraper strip for the scraper blade of a snowplow, which is provided at the top with a steel attachment neck, onto which a rubber body having at least one embedded hard material body is vulcanized. Such a sandwich scraper strip is known from DE 34 04 030 C1.

The hard material bodies of the aforementioned sandwich scraper strip are rod-shaped or plate-shaped molded bodies that preferably consist of sintered or cast corundum. Such sandwich scraper strips have proven themselves in excellent manner.

From U.S. Pat. No. 3,934,654, a scraper strip for the blade of a construction machine or for a snowplow is known, which has a steel moldboard onto the underside of which a plurality of steel segments are screwed. The steel segments are preferably forged from a tool steel, which has a greater wear resistance than the steel of the moldboard. In the region of the wear surface that faces the ground, V-shaped hard metal cores are inserted into the steel segments.

In contrast to the sandwich scraper strips described initially, the solid metallic scraper strip, provided with hard metal cores, of the American design is too aggressive for German roads. In connection with the plowing of roads until they are completely free of snow that is usual in Germany, the hard metal edge would damage the asphalt surface. In order to prevent this, plowing the road to leave a thin layer of snow on it would have to take place. But this does not meet the requirements of the German snow removal services.

Furthermore, the edge of the hard metal core that projects downward is also exposed to impacts, in unprotected manner. Thus there is the risk that a manhole cover or a bridge join that projects only slightly above the surface of the road can bump against the hard metal core and break out parts of it. Aside from these disadvantages, solid steel scraper strips having a hard metal core demonstrate good wear behavior.

Proceeding from the state of the art as described above, the present invention is based on the task of indicating a scraper strip that is exposed to low wear, has a correspondingly long useful lifetime, does not damage the road surface, and is also suitable for plowing the road completely free of snow.

This is accomplished with a sandwich scraper strip of the type stated initially, in which a hard metal core is provided as the hard material body, which core is surrounded by a steel jacket.

Surprisingly, it has been shown that the hard metal cores used in the scraper strip according to the invention, with all-around steel shielding, demonstrate clearly better wear behavior than the hard material bodies made of corundum that have successfully been used until now. This can be explained by the fact that the brittle corundum is exposed to shocks that make parts of the hard material body break out, despite the damping rubber body. This is particularly true for the border regions between rubber and corundum.

In contrast, the edges of the hard metal, which are sensitive to shocks, are protected by the tough steel jacket in the case of the sandwich scraper strip according to the invention, which jacket in turn is surrounded by the damping rubber body. Preliminary test bench experiments have shown that the lifetime of a sandwich scraper strip according to the invention is significantly greater than that of a conventional sandwich scraper strip having a hard material body made of corundum.

In contrast to what is the case with solid steel scraper strips, the asphalt surface is not noticeably damaged by sandwich scraper strips according to the invention having a hard metal core.

Of course, the hard metal core must be firmly anchored in the steel jacket. This can be done by means of force fit—such as by means of shrinking it in, for example—and/or by means of material fit—such as by means of soldering, for example.

Another advantage of the use of a steel jacket according to the invention consists in its better heat distribution. A lot of heat is produced by means of the friction of the hard metal core on the asphalt, and this is transferred from the steel into the rubber by way of large-area border surfaces. Since local overheating of the rubber is thereby avoided, clearly less wear occurs than if the hard metal cores are directly embedded into the rubber.

Hard metals are comparatively expensive materials. The costs of the sandwich scraper strip can be significantly reduced in that hard metal cores made of recycled hard metal are used. This recycled material is obtained by processing used material of worn tools used for cutting machining. Thus, for example, hard metal turning plates that are used in lathe chisels or milling heads can be re-used as a hard metal core in the sandwich scraper strip according to the invention, after their useful lifetime in cutting machining has ended.

Preferably, the steel jacket, or the hard metal core, respectively, is configured as a rod-shaped or plate-shaped molded body that extends over the total wear height of the sandwich scraper strip, in the most advantageous case.

Hard metal core and steel jacket together are supposed to take up a high proportion of the area of the wear surface of the rubber body. Their surface proportion should be at least 20%.

An advantageous further development consists in covering the rubber body with steel plates on its front and on its rear. In this way, the sandwich scraper strip becomes particularly rigid and even removes snow that has been driven down and crusted over from the asphalt surface, without leaving any residue.

If the rubber body of the sandwich scraper strip is covered with steel plates on both sides, it is recommended, for weight reasons, to do without a separate attachment neck and instead to utilize at least one of the two steel plates as an attachment neck, at the same time.

The best functionality is developed by a scraper strip whose wear surface is composed, in cross-section, of a seven-layer sandwich. The individual layers are—viewed counter to the advancing direction of the scraper blade—the steel of the rear steel plate, the rubber of the rubber body, the steel of the steel jacket, the hard metal of the hard metal core, the steel of the steel jacket, the rubber of the rubber body, and the steel of the front steel plate. With reference to the hard metal core, the sandwich therefore has a symmetrical structure, and protects the brittle core from shocks.

Figure 2:
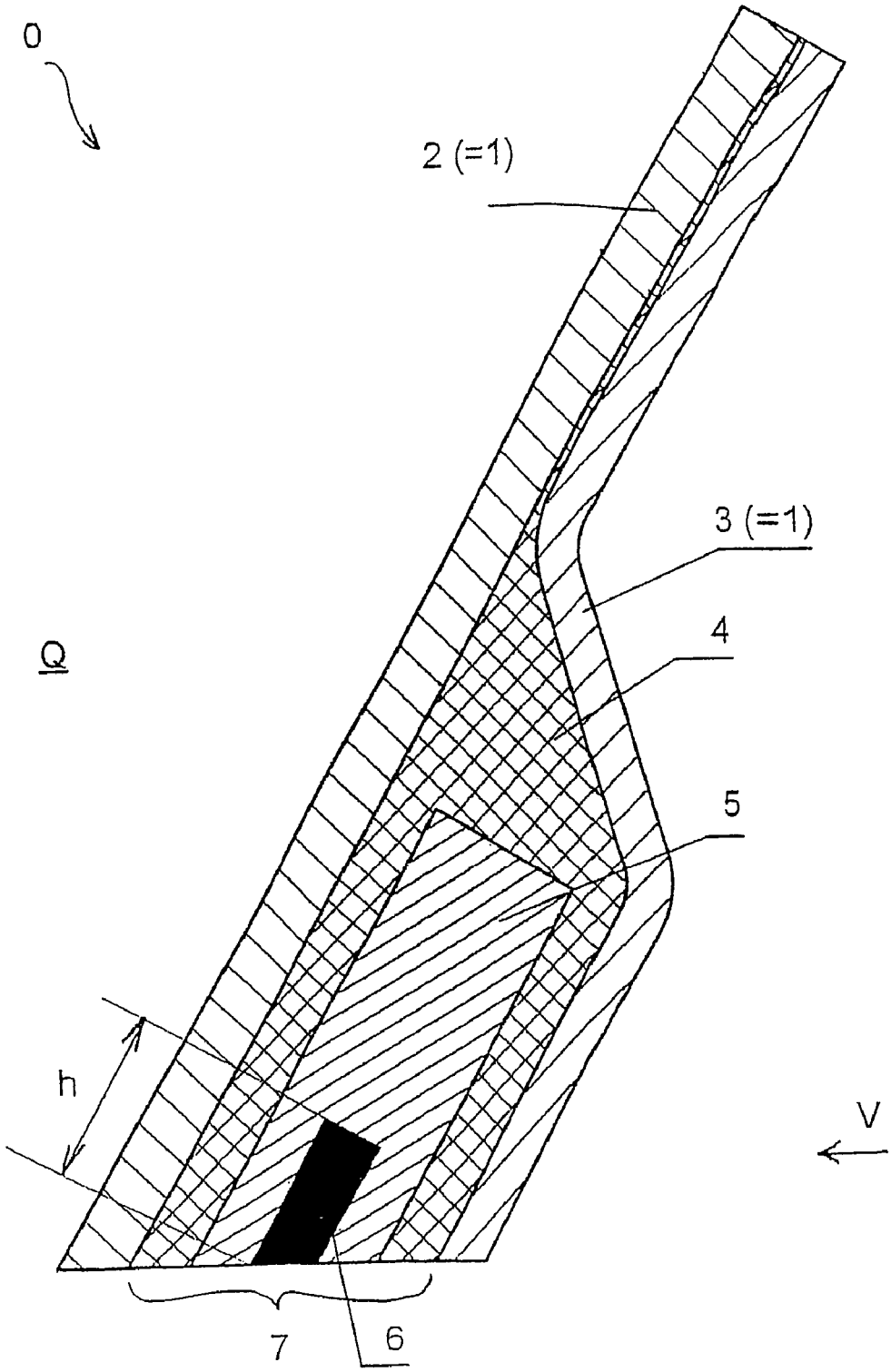
Figure 3:
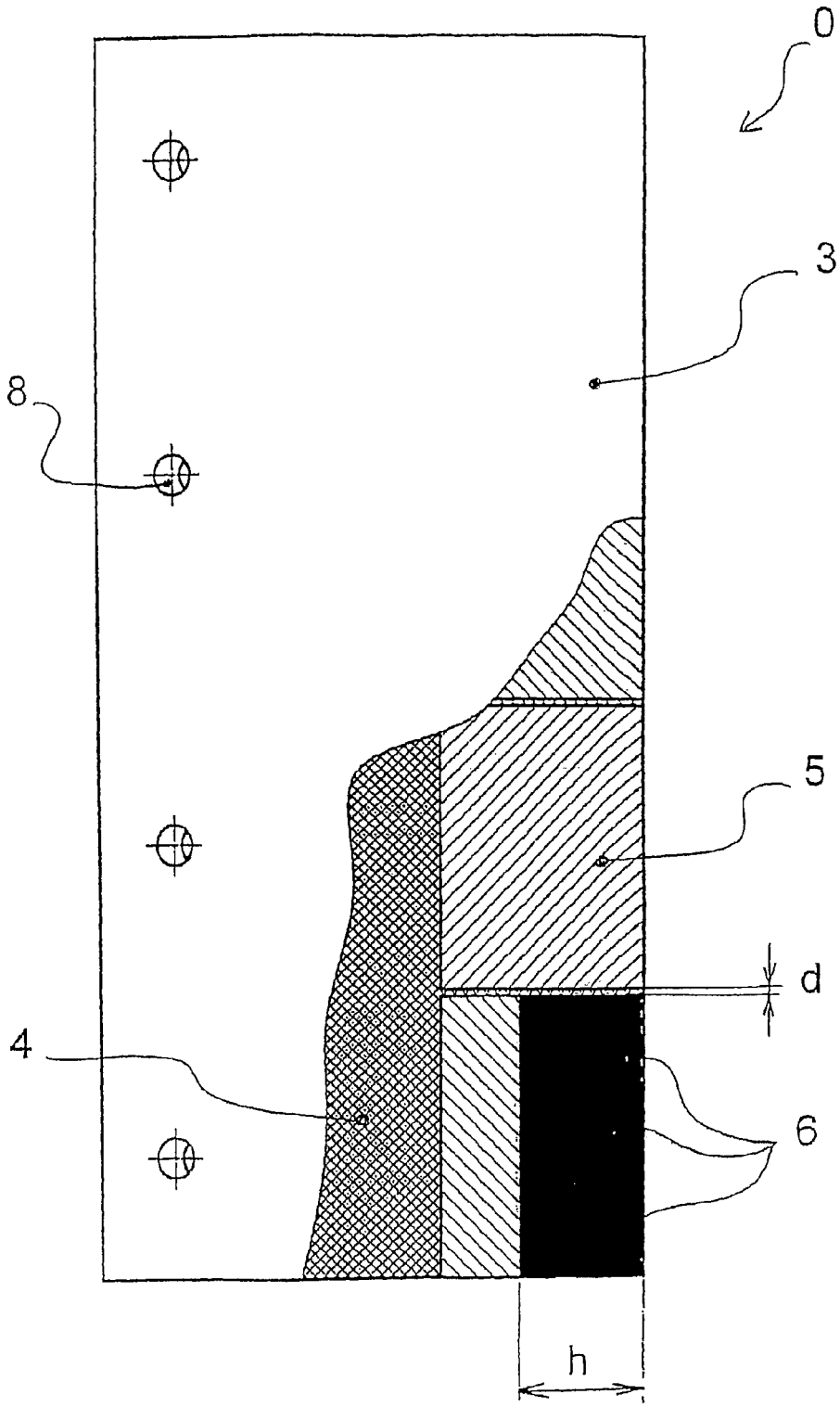

The present invention will now be explained in greater detail, using an exemplary embodiment. For this purpose, the figures show:

FIG. 1: sandwich scraper strip in cross-section;

FIG. 2: sandwich scraper strip with steel plates on both sides, in cross-section Q;

FIG. 3: sandwich scraper strip with steel plates on both sides, in a front view.

FIG. 1 shows a first embodiment of the sandwich scraper strip 0 according to the invention, in cross-section, in other words essentially crosswise to the direction of travel, i.e. advancing direction V. At its top, the sandwich scraper strip 0 has a steel attachment neck 1, by way of which it can be attached to the scraper blade, not shown, of a snowplow, also not shown. Generally, attachment takes place by means of screw connections or gripping claws; other joining techniques are possible.

Furthermore, the sandwich scraper strip 0 comprises a rubber body 4, which is vulcanized onto the attachment neck 1. Rubber has proven itself as a material, although it is also possible to substitute a suitable plastic for it.

A steel jacket 5 is embedded into the rubber body 4, which jacket surrounds one or more hard metal cores 6. Both the steel jacket 5 and the hard metal cores 6 can extend continuously over the entire length of the sandwich scraper strip 0. Preferably, however, they are interrupted in certain sections. The hard metal cores 6 extend, in each instance, at least over the wear height h of the scraping strip 0. Steel jacket 5 and hard metal core 6 together make up at least one fifth of the wear surface 7 of the rubber body 4.

The hard metal cores 6 preferably consist of tungsten carbide, titanium carbide, or titanium nitride. These materials can also be used as recycled material. The hard metal cores 6 are either shrunk into the steel jacket 5 and/or soldered to it. The steel jacket 5, on the other hand, is vulcanized into the rubber body 4.

In the wear surface 7 of the rubber body 4, which faces the road surface, the sandwich scraper strip 0 is formed by a five-layer, symmetrical sandwich. The sandwich consists of the materials rubber, steel, hard metal, steel, rubber.

FIG. 2 shows another embodiment of the sandwich scraper strip 0 according to the invention, in accordance with claim 8, in a cross-section Q. It comprises two steel plates 2, 3, which cover the rubber body 4 on its front and on its rear, respectively. The front steel plate 2 is essentially planar, the rear steel plate 3 is cropped. Both steel plates 2, 3 are connected with the rubber body 4 by means of vulcanization, and serve, at the same time, as an attachment neck 1. For this reason, they have bores 8 in the upper region, through which screw bolts, not shown, are inserted for the purpose of attachment to the scraper blade.

In the overall wear surface that faces the road surface (i.e. the wear surface 7 of the rubber body 4 plus the wear surfaces of the outer steel plates 2, 3), the sandwich scraper strip 0 according to claim 8 is formed by a seven-layer, symmetrical sandwich. The sandwich consists of the materials steel, rubber, steel, hard metal, steel, rubber, steel.

In the partially broken open front view of the second embodiment according to claim 8 (FIG. 3), it can be seen that several plate-shaped steel jackets 5 are disposed next to one another, maintaining a certain distance d. Three block-shaped hard metal cores 6 are shrunk into each steel jacket 5, in each instance.

The invention claimed is:

1. A sandwich scraper strip for the scraper blade of a snowplow, comprising:

a steel attachment neck;

a damping rubber body vulcanized onto said steel attachment neck; and at least one hard material body comprising a hard metal core surrounded by a steel jacket covering at least a front side, rear side and top side of said hard metal core, said hard material body being embedded in said damping rubber body so as to form over a wear height of said scraper strip a five layer sandwich consisting of the following layers in order:

(a) rubber of the rubber body;

(b) steel of the steel jacket;

(c) hard metal of the hard metal core;

(d) steel of the steel jacket; and (e) rubber of the rubber body.

2. The sandwich scraper strip according to claim 1, wherein the hard metal core is held in the steel jacket with a force fit.

3. The sandwich scraper strip according to claim 1, wherein the hard metal core is held in the steel jacket with a material fit.

4. The sandwich scraper strip according to claim 1, wherein the hard metal core consists of recycled material.

5. The sandwich scraper strip according to claim 1, wherein the steel jacket is configured as a rod-shaped or plate-shaped molded body that extends at least over the entire wear height of the sandwich scraper strip.

6. The sandwich scraper strip according to claim 1, wherein the hard metal core is configured as a rod-shaped or plate-shaped molded body that extends at least over the entire wear height of the sandwich scraper strip.

7. The sandwich scraper strip according to claim 1, wherein a common surface proportion of the steel jacket and the hard metal core makes up at least 20% of the wear surface of the rubber body.

8. The sandwich scraper strip according to claim 1, wherein the rubber body is covered with steel plates on its front and on its rear.

* * * * *